US005908811A

United States Patent [19]

Das

[11] Patent Number: 5,908,811

[45] Date of Patent: Jun. 1, 1999

[54] HIGH $T_C$ SUPERCONDUCTING FERROELECTRIC TUNABLE FILTERS

[76] Inventor: Satyendranath Das, P.O. Box 574, Mt. View, Calif. 94042-0574

[21] Appl. No.: 08/810,253

[22] Filed: Mar. 3, 1997

[51] Int. Cl.[6] ..... H01P 1/203

[52] U.S. Cl. ..... 505/210; 505/700; 505/701; 505/866; 333/99.005; 333/205; 333/253

[58] Field of Search ..... 333/995, 205, 333/204, 219, 235; 505/210, 700, 701, 866

[56] References Cited

U.S. PATENT DOCUMENTS

| | | | |
|---|---|---|---|
| 5,328,889 | 7/1994 | Sun et al. | 333/204 X |
| 5,472,935 | 12/1995 | Yandrofski et al. | 333/995 X |
| 5,496,796 | 3/1996 | Das | 333/995 X |
| 5,616,538 | 4/1997 | Hey-Shipton et al. | 505/210 |
| 5,679,624 | 10/1997 | Das | 333/995 X |

FOREIGN PATENT DOCUMENTS

| | | | |
|---|---|---|---|
| 1608759 | 11/1990 | Russian Federation | 333/204 |

*Primary Examiner*—Benny T. Lee

[57] ABSTRACT

This invention pertains to monolithic filters of the band-pass or band-reject type which a single crystal ferroelectric material having an electric field dependent permittivity. The filters are comprised of: a first layer of a single crystal dielectric material; a second layer of a single crystal high $T_c$ superconductor material; a third layer of a single crystal ferroelectric material; and a fourth layer of high $T_c$ superconductive microstrip lines configured into the various filter circuits, including resonator circuits and transformer circuits. The filters are capable of operating at power levels up to 0.5 MW at a temperature slightly above the Curie temperature to avoid hysteresis.

20 Claims, 4 Drawing Sheets

FIG.7
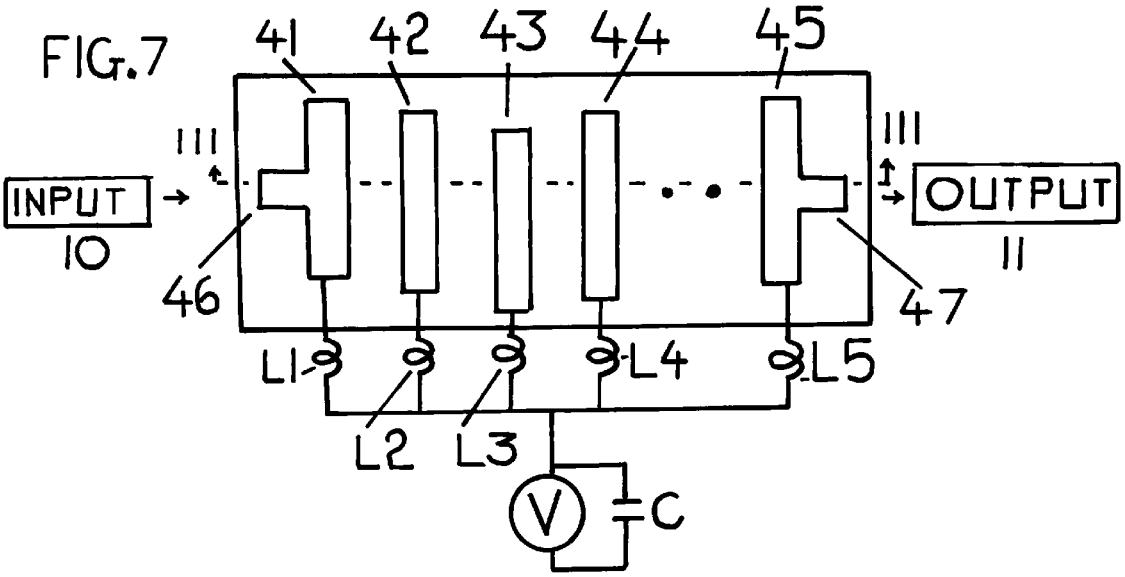
FIG.8
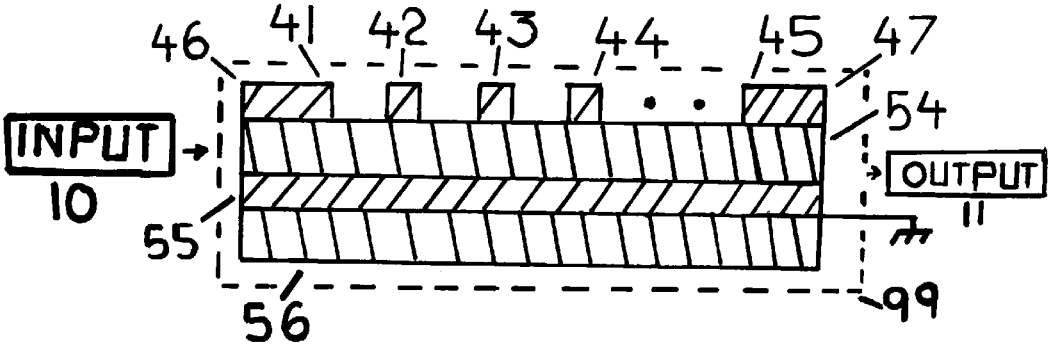
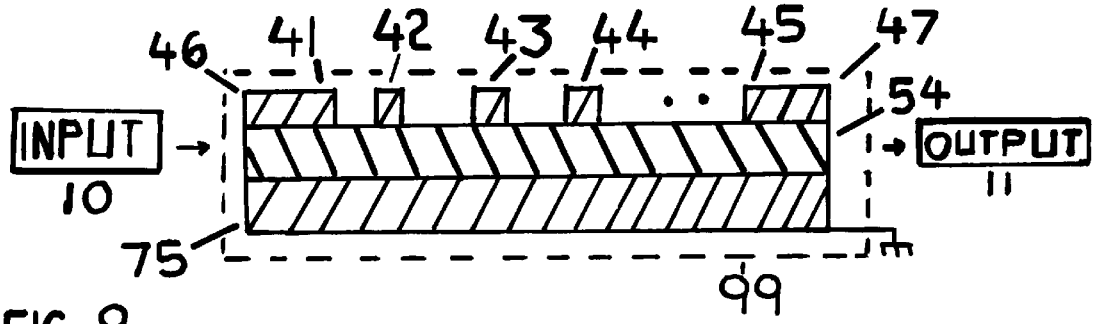
FIG.9

HIGH $T_C$ SUPERCONDUCTING FERROELECTRIC TUNABLE FILTERS

FIELD OF INVENTION

The present invention relates to filters for electromagnetic waves and more particularly, to RF filters which can be controlled electronically. Commercial YIG filters are available.

DESCRIPTION OF THE PRIOR ART

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device Is small in size. The ferroelectrics are operated in the paraelectric phase, i.e. slightly above the Curie temperature to prevent hysteresis which introduces a hysteresis loss with an a.c. biasing field. Inherently, they have a broad bandwidth. They have no low frequency limitation as contrasted to ferrite devices. The high frequency operation Is governed by the relaxation frequency, such as 95 GHz for strontium titanate, of the ferroelectric material. The loss of the ferroelectric high Tc superconductor RF tunable filters is low for ferroelectric materials, particularly single crystals, with a low loss tangent. A number of ferroelectrics are not subject to burnout. Ferroelectric tunable filters are reciprocal. Because of the dielectric constant of these devices vary with a bias voltage, the impedance of these devices vary with a biasing electric field;

There are three deficiencies to the current technology: (1) The insertion loss is high as shown by Das, U.S. Pat. No. 5,451,567. (2) The properties of ferroelectrics are temperature dependent (3) The third deficiency is the variation of the VSWR over the operating range of the time delay device.

It is stated in U.S. Pat. No. 5,459,123, that Das used a composition of polycrystalline barium titanate, of stated Curie temperature being 20 degrees C and of polythene powder in a cavity and observed a shift in the resonant frequency of the cavity with an applied bias voltage based on the publication by S. Das, "Quality of a Ferroelectric Material," IEEE Trans. MTT-12, pp. 440–448, July 1964.

It is stated in U.S. Pat. No. 5,496,795 to Das, that Das discussed operation, of microwave ferroelectric devices, slightly above the Curie temperature, to avoid hysteresis and showed the permittivity of a ferroelectric material to be maximum at the Curie temperature and the permittivity to reduce in magnitude as one moves away from the Curie temperature based on the publication by S. Das, "Quality of a Ferroelectric Material", IEEE Trans. MTT-12, pp. 440–445, July, 1964.

It is stated in U.S. Pat. No. 5,496,795, that another object of this design is to design phase shifters to handle power levels of at least 0.5 Megawatt based on the publication by G. Shen, C. Wilker, P. Pang and W. L. Holstein, "High Tc Superconducting-sapphire Microwave resonator with Extremely High Q-values Up To 90K," IEEE MTT-S Digest, pp. 193–196, 1992.

SUMMARY OF THE INVENTION

The invention includes band pass and reject tunable filters in the configuration of four layer microstrip devices. A first layer is a sheet of a single crystal dielectric material. Examples of dielectric materials are sapphire and lanthanum aluminate. A second layer is a film of a single crystal high Tc superconductor deposited on the sheet of single crystal dielectric material and which is connected to an external ground. Examples of such superconductors are YBCO and TBCCO. A third layer is a film of a single crystal ferroelectric material deposited on the film of single crystal high Tc superconductor. Examples of single crystal ferroelectric materials are $KTa_{1-x}Nb_xO_3$ or $Sr_{1-x}Pb_xTiO_3$ where the value of x is between 0.005 and 0.7. A fourth layer contains microstrip lines, shaped for a band pass or a band reject filter, composed of a single crystal high Tc superconductor and deposited on the film of a single crystal ferroelectric material. Application of a bias voltage changes the permittivity of the ferroelectric material and the operating frequency of the tunable filter. Microstrip line quarter wavelength long transformers, deposited on the same ferroelectric material film as that used for the filter, are used to provide impedance matching of the input of the filter to an input circuit of the filter and matching the output of the filter to an output circuit of the filter. One object of the invention is to reduce the loss of the tunable filter to a minimum value. The use of a single crystal ferroelectric material reduces the dielectric loss of the ferroelectric material to a minimum value. The use of a single crystal dielectric material reduces its dielectric loss to a minimum. The use of a single crystal high Tc superconductor reduces the conductive loss to a minimum. Another object of the invention is (1) to obtain a single valued variable dielectric constant as a function of the biasing voltage and (2) eliminate hysteresis loss present with an a.c. biasing voltage by operating the tunable filter slightly above the Curie temperature. Another object of this invention is the ability to operate the tunable filter up to a 0.5 MW level of RF power. Another object of this invention is to obtain a reciprocal device. Another object of this invention is to obtain epitaxial deposition of a high Tc superconductor on a ferroelectric material.

Another object of the invention is to obtain a minimum dielectric loss, which is the predominant loss of the ferroelectric materials, by the use of single crystal ferroelectric and single crystal dielectric materials. Another objective is to obtain a minimum conductive loss by the use of single crystal high Tc superconductor materials.

Depending on a trade-off study in an individual case, the best type of tunable filter can be selected.

With these and other objectives in view, as will be more particularly pointed out in detail in the appended claims, reference is now made to the following description taken in connection with the accompanying diagrams.

BRIEF DESCRIPTION OF THE DRAWINGS

FIG. 7 is a top view depicting another embodiment of my invention, a monolithic tunable ferroelectric band pass filter.

FIG. 8 depicts a longitudinal cross-section view of FIG. 7.

FIG. 9 depicts another longitudinal cross-section view of FIG. 7.

DETAILED DESCRIPTION OF THE PREFERRED EMBODIMENT

Figure 1:
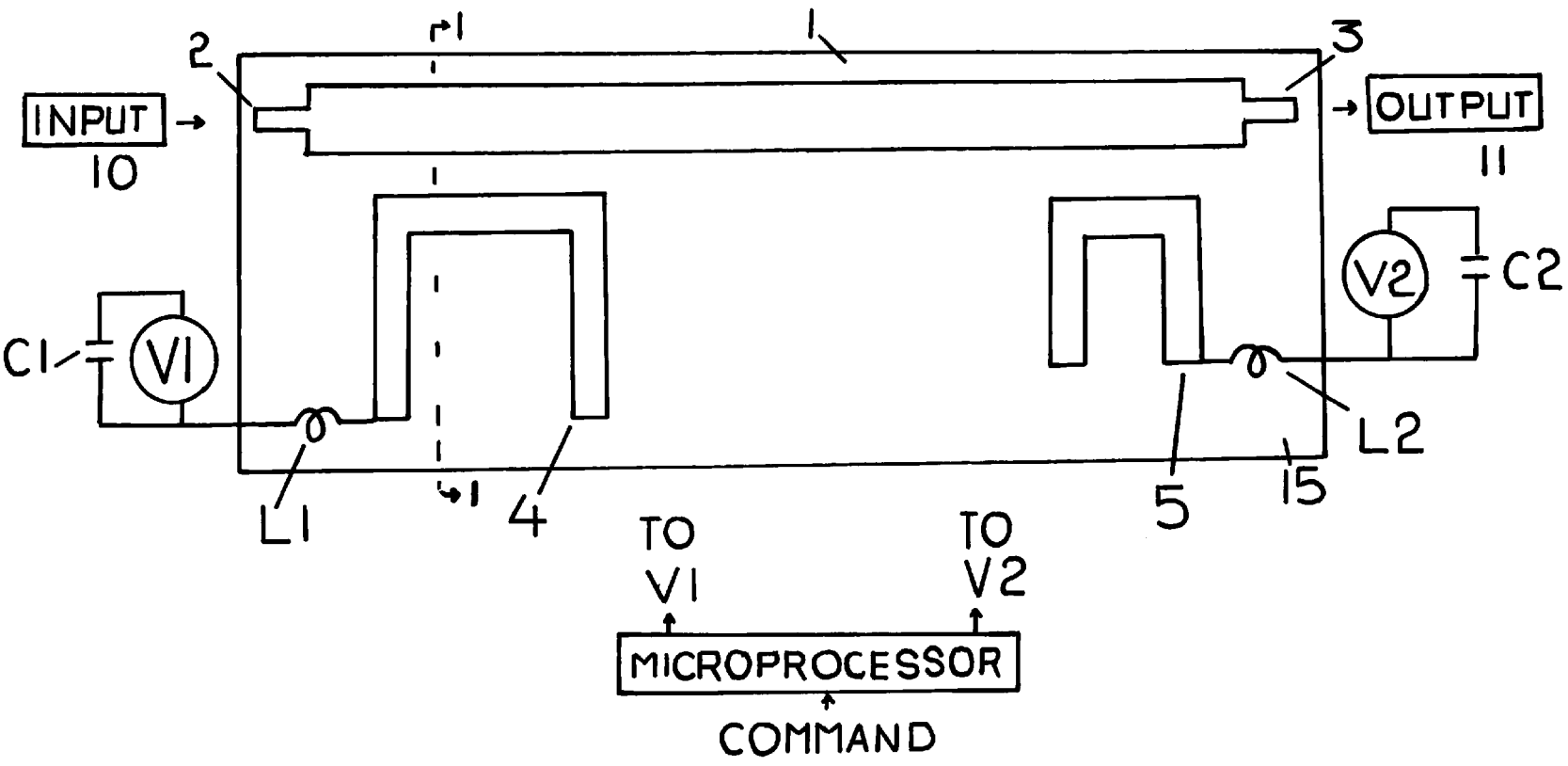
FIG. 1 is a top view of an embodiment of my invention.

FIG. 1 is a top view of an embodiment of my invention. It is a film of a single crystal high Tc superconductor material, such as YBCO or TBCCO and is a part of a monolithic single crystal ferroelectric tunable band reject filter. The tunable band reject filter's main microstrip line is 1. Generally, the permittivity of the ferroelectric film 15, below the single crystal high Tc superconductor film, is high and the resulting impedance of the microstrip line 1 is low. To match the impedance of the tunable band reject filter microstrip line 1 to the impedance of an input circuit of the tunable filter, a quarter wavelength long , at an operating frequency of the tunable band reject filter, matching transformer 2 is used. For matching the impedance of the tunable band reject filter microstrip line 1 to the impedance of the output circuit of the tunable band reject filter, a quarter wavelength long, at an operating frequency of the tunable band reject filter, matching transformer 3 is used. A half wave resonator 4 is inductively coupled to the main microstrip transmission line 1 and provides a short circuit at the resonant frequency of the resonator. There is no effect off resonance. The coupling length, between the main transmission line 1 and the resonator 4, is a small percentage of the total resonator length and is adjusted to increase or decrease the bandwidth of the filter. It is inductively coupled in the middle of the resonator. The tunable band reject filter is operated at a high Tc superconducting temperature slightly above the Curie temperature of the ferroelectric film. An inductance L1 provides a high impedance at an operating frequency of the tunable filter. Any RF energy present after the inductance L1 is bypassed to the ground by the capacitor C1. A bias voltage V1 is applied to the resonator of the tunable band reject filter to change the permittivity and as such the resonant frequency of the tunable band reject filter. The input is 10 and the output is 11. The tunable filter is reciprocal. A second resonator 5 is shown in FIG. 1 which is tuned to a different or same frequency depending on the requirements of the filter. The bias filter is comprised of inductance L2 and capacitor C2. A voltage V2 is applied to the resonator 5 to change its resonant frequency. To eliminate or to reduce the interference at different frequencies, resonators tuned to different frequencies are used. Only two resonators are shown in FIG. 1, but n resonators can be used. The separation distance between the centers of the resonators is typically three quarters of a wavelength or a value determined by the requirements of the filter. The bias voltages, and thus the reject frequencies, can be independently controlled by a microprocessor whose outputs are fed to the bias voltage sources.

Figure 2:
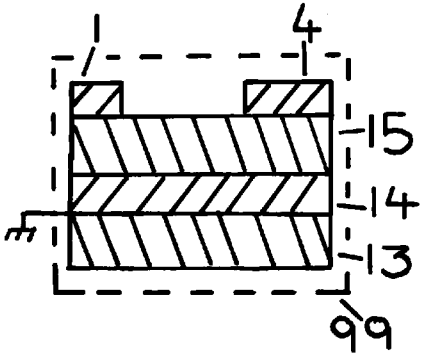
FIG. 2 is a transverse cross-section view, through a resonator 4, of FIG. 1, the tunable band reject filter.

FIG. 2 is a transverse cross-section I—I view of the tunable band reject filter, through a resonator 4, of FIG. 1. A single crystal dielectric material, such as sapphire, is the substrate 13. On top of the substrate 13 is deposited a film 14 of a single crystal high Tc superconductor, such as YBCO or TBCCO, which is grounded. On top of the film 14 is deposited a film 15 of a single crystal ferroelectric material such as $KTa_{1-x}Nb_xO_3$ or $Sr_{1-x}Pb_xTiO_3$ where the value of x is between 0.005 and 0.7. On top of the film 15 are deposited films 1 and 4 of a single crystal high Tc superconductor material. The cross-section of the main transmission line is 1. The cross-section of the coupled resonator is 4. An inductance L1 provides a high impedance at an operating frequency of the tunable band reject filter. Any remaining RF energy is bypass to the ground by the capacitor C1. A bias voltage V1 applied to the resonator 4 of the band reject filter changes the permittivity of the ferroelectric film 15 and as such the operating frequency of the band reject filter. The tunable band reject filter is a monolithic microwave integrated circuit (MMIC).

Figure 3:
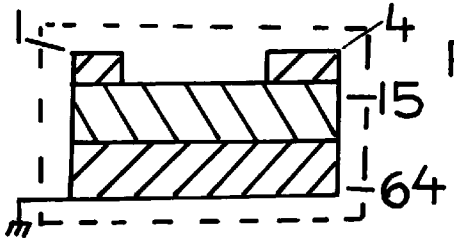
FIG. 3 is another transverse cross-section view, through a resonator 4, of FIG. 1, depicting another embodiment of the tunable band reject filter.

The tunable band reject filter is operated at a high Tc superconducting temperature slightly above the Curie temperature of the ferroelectric film. Element 99 is the means to keep the tunable filter at a high superconducting temperature FIG. 3 is another transverse cross-section, through a resonator 4, of FIG. 1, depicting another embodiment of the tunable band reject filter. A single crystal high Tc superconductor, such as YBCO or TBCCO, is the substrate 64 which is grounded. On top of the substrate 64 is deposited a film 15 of a single crystal ferroelectric material such as $KTa_{1-x}Nb_xO_3$ or $Sr_{1-x}Pb_xTiO_3$ where the value of x is between 0.005 and 0.7. On top of the film 15 are deposited films 1 and 4 of a single crystal high Tc superconductor material. The cross-section of the main transmission line is 1. The cross-section of the coupled resonator is 4. An inductance L1 provides a high impedance at an operating frequency of the tunable band reject filter. Any remaining RF is bypass to the ground by the capacitor C1. A bias voltage V1 applied to the resonator 4 of the band reject filter changes the permittivity of the ferroelectric film 15 and as such the operating frequency of the band reject filter. The tunable band reject filter is a monolithic microwave integrated circuit (MMIC). The tunable band reject filter is operated at a high Tc superconducting temperature slightly above the Curie temperature of the ferroelectric film.

Figure 4:
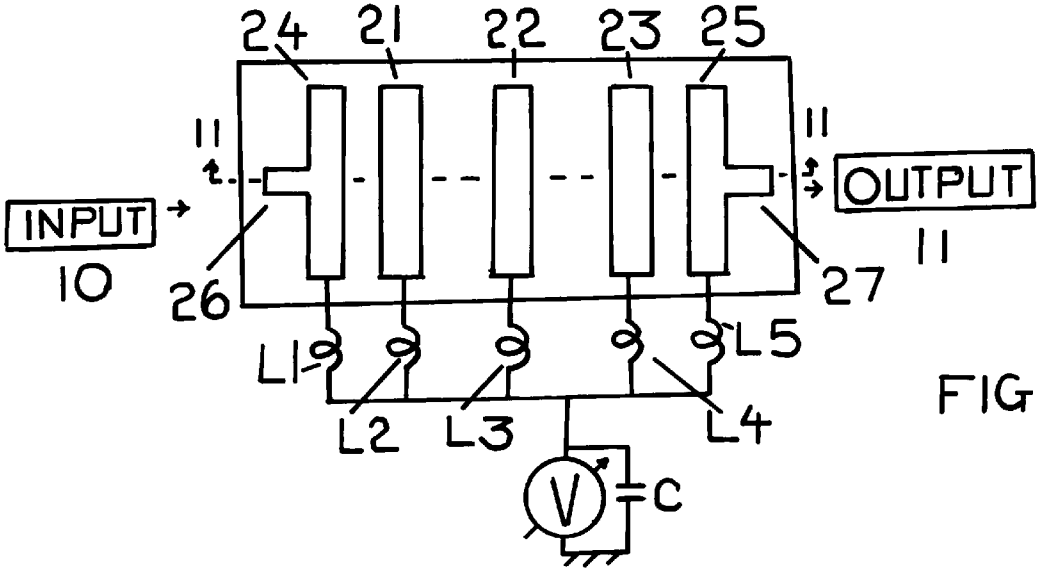
FIG. 4 depicts a top view of another embodiment of my invention, a monolithic band pass tunable ferroelectric filter.

FIG. 4 depicts a top view of another embodiment of my invention, a monolithic band pass tunable ferroelectric filter. It consists of interdigital microstrip lines 21, 22, 23 comprised of a film of a high Tc superconductor material such as YBCO or TBCCO. There are 1st through nth parallel microstrip lines having a separation between the $2^{nd}$ through $(n-1)^{th}$ microstrip lines. The separation distance between the $1^{st}$ and $2^{nd}$ microstrip lines and the separation distance between the (n−1)th and the nth microstrip lines respectively are smaller than the separation distance between the rest of the microstrip lines. The $1^{st}$ through nth microstrip lines are separate from each other respectively. Each microstrip line is half a wavelength long at an operating frequency of the filter. The coupled lines are 24 and 25. The high Tc superconductor film is deposited on a single crystal ferroelectric film. Generally, the permittivity of a ferroelectric film is large and as such the impedance of the microstrip line is low. For matching the impedance of the input of the tunable filter to an impedance of the input circuit of the tunable filter, a quarter wavelength, at an operating frequency of the tunable filter, matching transformer 26 is used. For matching the impedance of the output of the tunable filter to an impedance of the output circuit of the tunable filter, a quarter wavelength, at an operating frequency of the filter, matching transformer 27 is used. The tunable band reject filter is operated at a high Tc superconducting temperature slightly above the Curie temperature of the ferroelectric film. Inductances L1, L2, L3, L4 and L5 provide a high impedance at an operating frequency of the tunable filter. Any RF energy present after the inductances L1, L2, L3, L4 and L5 is by passed to the ground by the capacitor C. A bias voltage V is applied to the microstrip lines of the tunable band pass filter to change the permittivity and as such the resonant frequency of the tunable band pass filter. The input is 10 and the output is 11. The tunable band pass filter is reciprocal. Only three microstrip lines are shown in FIG. 4, but n microstrip lines can be used depending on the tunable filter requirements.

Figure 5:
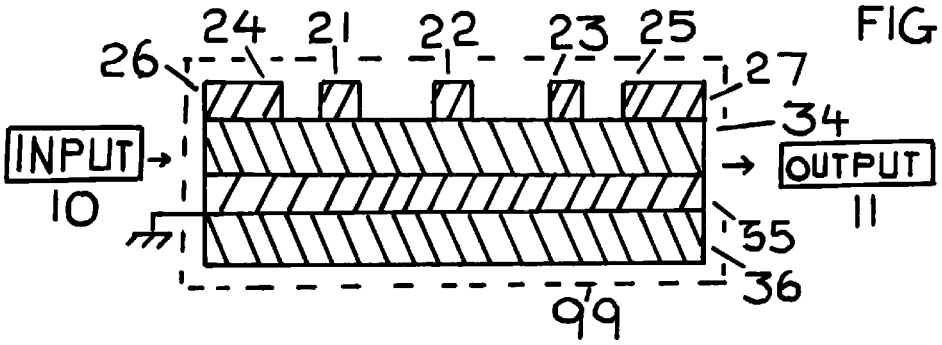
FIG. 5 is a longitudinal cross-section view of FIG. 4 of the monolithic tunable band pass ferroelectric filter.

FIG. 5 is longitudinal cross-section II—II of the monolithic tunable band pass ferroelectric filter. A single crystal dielectric, such as sapphire, substrate is 36. On top of the substrate 36 is deposited a film 35 of a single crystal high Tc superconductor material, such as YBCO or TBCCO, which is grounded. On top of the film 35 is deposited a film 34 of a single crystal ferroelectric material such as $KTa_{1-x}Nb_xO_3$ or $Sr_{1-x}Pb_xTiO_3$ where the value of x is between 0.005 and 0.7. On top of the film 34 of a ferroelectric material is deposited films 26, 24, 21, 22, 23, 25 and 27. The matching transformers are 26 and 27. The input matching transformer 26 cross-section is continuous with the microstrip line 24. The cross-section of the output matching transformer 27 is continuous with the microstrip line 25. The tunable band pass filter is operated at a high Tc superconducting temperature slightly above the Curie temperature of the ferroelectric film. The band pass filter is reciprocal. Cross-sections of only three microstrip lines are shown in FIG. 5, but n microstrip lines can be used depending on the tunable filter requirements. The band pass filter is a monolithic microwave integrated circuit (MMIC). Element 99 is the means to keep the tunable filter at a high superconducting temperature.

Figure 6:
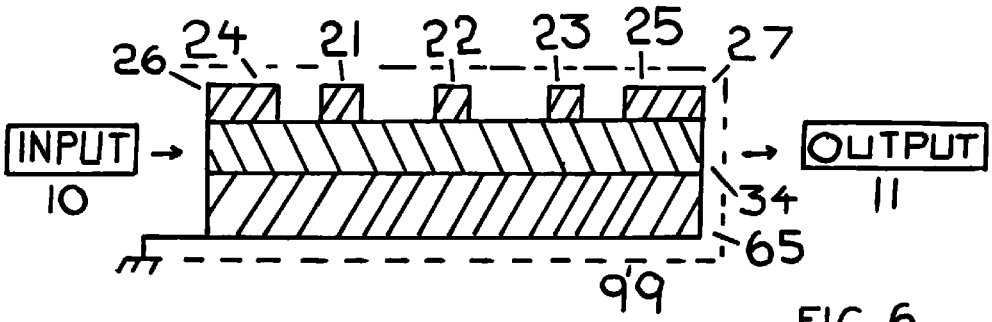
FIG. 6 is another longitudinal cross-section view of FIG. 4 of the monolithic tunable band pass ferroelectric filter.

FIG. 6 is a longitudinal cross-section of another monolithic tunable band pass ferroelectric filter embodiment of FIG. 4. A single crystal high Tc superconductor material, such as YBCO or TBCCO, is the substrate 65 which is grounded. On top of the substrate 65 is deposited a a film 34 of a single crystal ferroelectric material such as $KTa_{1-x}Nb_xO_3$ or $Sr_{1-x}Pb_xTiO_3$ where the value of x is between 0.005 and 0.7. On top of the film 34 of a ferroelectric material are deposited conductive films. Elements 26, 24, 21, 22, 23, 25 and 27 are cross-sections of conductive films. The matching transformers are 26 and 27. The input matching transformer 26 cross-section is continuous with the microstrip line 24. The cross-section of the output matching transformer 27 is continuous with the microstrip line 25. The tunable band pass filter is operated at a high Tc superconducting temperature slightly above the Curie of the ferroelectric film. The band pass filter is reciprocal. Cross-sections of only three microstrip lines are shown in FIG. 6, but n microstrip lines can be used depending on the tunable filter requirements. The band pass filter is a monolithic microwave integrated circuit (MMIC).

FIG. 7 is a top view depicting another embodiment of my invention, a monolithic tunable ferroelectric band pass filter, Half wavelength, at an operating frequency of the tunable filter, parallel staggered microstrip lines, comprised of a film of a single high Tc superconductor material such as YBCO or TBCCO, are 41, 42, 43, 44 and 45. Only five poles or microstrip lines are shown for simplicity. There are n poles or microstrip lines, in a tunable band pass filter, depending on the filter requirements. Each microstrip line is a half a wavelength long at an operating frequency of the filter. $1^{st}$ through nth microstrip lines are separate from each other respectively. Underneath the films 41, 42, 43, 44 and 45 of a single crystal high Tc superconductor is a film of a single crystal ferroelectric material. Generally, the permittivity of a single crystal ferroelectric material is large. As such, the impedance of the microstrip line is low. For matching the impedance of the band pass filter input to an impedance of an input circuit of the tunable band pass filter, a quarter wavelength, at an operating frequency of the tunable filter, matching transformer 46 is used. For matching the impedance of the output of the tunable band pass filter, a quarter wavelength, at an operating frequency of the filter, matching transformer 47 is used. The tunable band pass filter is operated at a high Tc superconducting temperature slightly above the Curie temperature of the ferroelectric film. Inductances L1, L2, L3, L4 and L5 provide a high impedance at an operating frequency of the tunable filter device. Any RF energy present after the inductances L1, L2, L3, L4 and L5 is bypass to the ground by the capacitor C. A bias voltage V is applied to the microstrip lines of the tunable band pass filter to change the permittivity and as such the resonant frequency of the tunable band pass filter. The input is 10 and the output is 11. The tunable band pass filter is reciprocal.

FIG. 8 depicts a longitudinal cross-section III—III of FIG. 7. A single crystal dielectric material, such as sapphire, is the substrate 56. On top of the substrate 56 is deposited a film of a single crystal high Tc superconductor, such as YBCO or TBCCO, 55 which is grounded. On top of the film 55, is deposited a film of a single crystal ferroelectric material 54 of $KTa_{1-x}Nb_xO_3$ or $Sr_{1-x}Pb_xTiO_3$, where the value of x is between 0.005 and 0.7. On top of the film 54 are cross-sections of films 46, 41, 42, 43, 44, 45 and 47 comprised of a single crystal high Tc superconductor material. The cross-sections of the input quarter wave transformer 46 and the half wave microstrip line are continuous. The cross-sections of the output quarter wave transformer 47 and the half wave microstrip line 45 are continuous. The tunable band pass filter is operated at a high Tc superconducting temperature slightly above the Curie temperature of the ferroelectric film. The band pass filter is reciprocal. The tunable band pass filter is a monolithic microwave integrated circuit (MMIC). Element 99 is the means to keep the tunable filter at a high superconducting temperature.

FIG. 9 depicts longitudinal cross-section of FIG. 7, in another embodiment of my invention. A single crystal high Tc superconductor, such as YBCO or TBCCO, comprises the substrate 75 which is grounded. On top of the substrate 75, is deposited a film of a single crystal ferroelectric material 54 of $KTa_{1-x}Nb_xO_3$ or $Sr_{1-x}Pb_xTiO_3$, where the value of x is between 0.005 and 0.7. On top of the film 54 are cross-sections of films 46, 41, 42, 43, 44, 45 and 47 comprised of a single crystal high Tc superconductor material. The cross-sections of the input quarter wave transformer 46 and the half wave microstrip lines are continuous. The cross-sections of the output quarter wave transformer 47 and the half wave microstrip line 45 are continuous. The tunable band pass filter is operated at a high Tc superconducting temperature slightly above the Curie temperature of the ferroelectric film. The band pass filter is reciprocal. The tunable band pass filter is a monolithic microwave integrated circuit (MMIC). Each embodiment has four layers. The first layer is a sheet of a single crystal dielectric material. The second layer is a film of a single crystal high Tc superconductor, connected to an electrical ground, deposited on the sheet of the single crystal dielectric material of the first layer. The third layer is a film of a single crystal ferroelectric material deposited on the film of a single crystal high Tc superconductor of the second layer, a fourth layer is made of microstrip lines comprised of a film of a high Tc superconductor material deposited on the film of a single crystal ferroelectric material of the third layer. A bias voltage is connected between the third layer and the microstrip line(s) of the first layer.

It should be understood that the foregoing disclosure relates to only typical embodiments of the invention and that numerous modification or alternatives may be made therein by those of ordinary skill in art without departing from the spirit and the scope of the invention as set forth in the appended claims. Specifically, the invention contemplates various dielectrics including sapphire, lanthanum aluminate, ferroelectrics, ferroelectric liquid crystals (FLCs), high Tc superconducting materials including YBCO, TBCCO, impedances, MMICs, tunable filter configurations, layers of filter devices, operating bias voltage of the filters, number of resonators and frequencies.

What is claimed is:

1. A monolithic band reject tunable single crystal ferroelectric filter having electric field dependent permittivity, having different operating frequencies, an input, an output, an input circuit, an output circuit, a single crystal ferroelectric material, a Curie temperature and comprising:

a first layer being a sheet of a single crystal dielectric material;

a second layer of a film of a single crystal high Tc superconductor disposed on said first layer;

a third layer of a film of said single crystal ferroelectric material disposed on said film of said high Tc superconductor;

a fourth layer of a main microstrip transmission line disposed on said film of said single crystal ferroelectric material:

a first branch microstrip line resonator, half a wavelength long at a first said operating frequency of said filter, being disposed on said film of said single crystal ferroelectric material and being coupled to and separate from said main microstrip transmission line;

second, third . . nth branch microstrip line resonators, each half a wavelength long at respectively said second, third . . nth operating frequencies of said filter, being disposed on said film of said single crystal ferroelectric material as associated with said first branch microstrip line resonator and being respectively coupled to and separate from said main microstrip transmission line;

said first, second, third . . nth branch microstrip line resonator being respectively operated at different ones of said operating frequencies;

in the vicinity of a said resonant frequency of a corresponding said branch resonator, a large loss is introduced into said main microstrip transmission line;

respective separation distances between centers of adjacent resonators being typically three quarters of a wavelength at an operating frequency of said filter;

a microstrip line input transformer disposed on said film of said single crystal ferroelectric material and being a quarter wavelength long, at an operating frequency of said filter;

said input transformer being connected to and being a part of said main microstrip transmission line for matching an impedance of said input circuit of said filter to an input impedance of said main microstrip transmission line and providing a good impedance match;

a microstrip line output transformer disposed on said film of said single crystal ferroelectric material and being a quarter wavelength long, at an operating frequency of said filter;

said output transformer being connected to and being a part of said main microstrip transmission line for matching an impedance of said output circuit of said filter to an output impedance of said main microstrip transmission line and providing a good impedance match;

said main microstrip line, said first, second, third . . nth microstrip line resonators, said microstrip line input and output transformers being comprised of a film of a single crystal high Tc superconductor;

said single crystal dielectric material, said ferroelectric material and said high Tc superconductor being of high purity, (1) to obtain a minimum loss and (2) to obtain epitaxial deposition;

said tunable filter having a capability to operate at a power level from 25.1 W to 0.5 MW;

means, connected with said filter, for applying, across said second layer and respectively first, second, third . . nth microstrip resonators of said fourth layer, independent bias voltages for obtaining different operating frequencies of said filter; and said band reject tunable filter being operated at a high superconducting temperature slightly above said Curie temperature to avoid hysteresis.

2. A monolithic band pass tunable filter having an operating frequency, an input, an output, an input circuit, an output circuit, a single crystal ferroelectric material having an electric field dependent permittivity, a Curie temperature and comprising:

a first layer being a sheet of a single crystal dielectric material;

a second layer of a film of a single crystal high Tc superconductor disposed on said first layer;

a third layer of a film of said single crystal ferroelectric material disposed on said film of said high Tc superconductor;

first, second . . nth microstrip lines each half a wavelength long at said operating frequency of said filter;

a fourth layer of said first, second . . nth microstrip transmission line disposed on said film of said single crystal ferroelectric material;

said first, second, third . . nth microstrip lines being parallel and separate from each other;

the respective separation distances between first and second microstrip lines and between (n−1)th and nth microstrip lines being less than the respective separation distance between the remaining microstrip lines;

a first transmission means for coupling energy into said filter at said input;

said first microstrip line being coupled to and separate from a first coupled microstrip transmission line;

said nth microstrip line being coupled to and separate from a second coupled microstrip transmission line;

a microstrip line input transformer disposed on said film of said single crystal ferroelectric material and being a quarter wavelength long, at an operating frequency of said filter;

said input transformer being connected orthogonally to and being a part of said first coupled microstrip transmission line for matching an impedance of said input circuit of said filter to an input impedance of said filter and providing a good impedance match;

a microstrip line output transformer disposed on said film of said single crystal ferroelectric material and being a quarter wavelength long, at an operating frequency of said filter;

said output transformer being connected orthogonally to and being a part of said second coupled microstrip transmission line for matching an impedance of said output circuit of said filter to an output impedance of said filter and providing a good impedance match;

said first, second, third . . nth microstrip lines, coupled microstrip lines, said microstrip line input and output transformers being comprised of a film of said single crystal high Tc superconductor;

a second transmission means for coupling energy out of said filter at said output;

said single crystal dielectric material, said ferroelectric material and said high Tc superconductor being of high purity, (1) to obtain a minimum loss and (2) to obtain epitaxial deposition;

said tunable filter having a capability to operate at a power level from 25.1 W to 0.5 MW;

means, connected with said filter, for applying, across said second layer and respectively first, second, third . . nth microstrip lines of said fourth layer, independent bias voltages for obtaining said operating frequency of said filter; and said band pass filter being operated at a high superconducting temperature slightly above said Curie temperature to avoid hysteresis.

3. A tunable band pass filter of claim 2 wherein the single crystal dielectric material is sapphire.

4. A tunable band pass filter of claim 3 wherein the single crystal high Tc superconductor is YBCO.

5. A tunable band pass filter of claim 3 wherein the single crystal high Tc superconductor is TBCCO.

6. A tunable band pass filter of claim 2 wherein the single crystal dielectric material is lanthanum aluminate.

7. A tunable band pass filter of claim 6 wherein the single crystal high Tc superconductor is YBCO.

8. A tunable band pass filter of claim 6 wherein the single crystal high Tc superconductor is TBCCO.

9. A tunable band pass filter of claim 2 wherein the filter is a MMIC.

10. A monolithic band pass tunable filter having an operating frequency, an input, an output, an input circuit, an output circuit, a single crystal ferroelectric material having an electric field dependent permittivity, a Curie temperature and comprising:

a first layer being a sheet of a single crystal dielectric material;

a second layer of a film of a single crystal high Tc superconductor disposed on said first layer;

a third layer of a film of said single crystal ferroelectric material disposed on said film of said high Tc superconductor;

first, second . . nth microstrip lines each half a wavelength long at an operating frequency of said filter;

a fourth layer of said first, second . . nth microstrip transmission line disposed on said film of said single crystal ferroelectric material:

said first, second, third . . nth microstrip lines being parallel, staggered in length and separate from each other;

a first transmission means for coupling energy into said filter at said input;

a microstrip line input transformer disposed on said film of said single crystal ferroelectric material and being a quarter wavelength long, at said operating frequency of said filter;

said input transformer being connected orthogonally to and being a part of said first microstrip line for matching an impedance of said input circuit of said filter to an input impedance of said filter and providing a good impedance match;

a microstrip line output transformer disposed on said film of said single crystal ferroelectric material and being a quarter wavelength long, at said operating frequency of said filter;

said output transformer being connected orthogonally to and being a part of said nth microstrip line for matching an impedance of said output circuit of said filter to an output impedance of said filter and providing a good impedance match;

said first, second, third . . nth microstrip lines, said microstrip line input and output transformers being comprised of a film of said single crystal high Tc superconductor;

a second transmission means for coupling energy out of said filter at said output;

said single crystal dielectric material, said ferroelectric material and said high Tc superconductor being of high purity, (1) to obtain a minimum loss and (2) to obtain epitaxial deposition;

said tunable filter having a capability to operate at a power level from 25.1 W to 0.5 MW;

means, connected with said filter, for applying, across said second layer and respectively first, second, third . . nth microstrip lines of said fourth layer, independent bias voltages for obtaining said operating frequency of said filter; and said band pass filter being operated at a high superconducting temperature slightly above said Curie temperature to avoid hysteresis.

11. A tunable band pass filter of claim 10 wherein the single crystal dielectric material is sapphire.

12. A tunable band pass filter of claim 11 wherein the single crystal high Tc superconductor is YBCO.

13. A tunable band pass filter of claim 12 wherein the filter is a MMIC.

14. A tunable band pass filter of claim 11 wherein the filter is a MMIC.

15. A tunable band pass filter of claim 11 wherein the single crystal high Tc superconductor is TBCCO.

16. A tunable band pass filter of claim 15 wherein the filter is a MMIC and the single crystal ferroelectric material being KTN.

17. A tunable band pass filter of claim 10 wherein the filter is a MMIC.

18. A tunable band pass filter of claim 10 wherein the single crystal dielectric material is lanthanum aluminate.

19. A tunable band pass filter of claim 18 wherein the single crystal high Tc superconductor is YBCO.

20. A tunable band pass filter of claim 18 wherein the single crystal high Tc superconductor is TBCCO.

* * * * *